US005494026A

United States Patent [19]

Fujita et al.

[11] Patent Number: 5,494,026

[45] Date of Patent: Feb. 27, 1996

[54] DOME CONNECTING STRUCTURE OF EXTERNAL COMBUSTION HOT STOVE FOR BLAST FURNACE

[75] Inventors: Masao Fujita; Rikio Ono, both of Okayama; Teruaki Morimoto, Tokyo; Hiroshi Kanaya, Tokyo; Teruo Kanetsuna, Tokyo; Eiji Akimoto, Tokyo, all of Japan

[73] Assignee: Kawasaki Steel Corporation, Japan

[21] Appl. No.: 258,793

[22] Filed: Jun. 13, 1994

[30] Foreign Application Priority Data

Jun. 23, 1993 [JP] Japan ..... 5-151744

[51] Int. Cl.[6] ..... F24H 9/14

[52] U.S. Cl. ..... 126/119; 126/99 R; 126/98; 126/343.5 A; 126/114; 126/118

[58] Field of Search ..... 126/119, 99, 98, 126/343.5 A, 114, 118

[56] References Cited

U.S. PATENT DOCUMENTS 590,938 9/1897 Tinkham ..... 126/119

*Primary Examiner*—Larry Jones
*Attorney, Agent, or Firm*—Austin R. Miller

[57] ABSTRACT

A connecting structure of a blast furnace hot stove of the type in which a heat accumulation chamber dome and a combustion chamber dome are directly connected to each other through a dome connecting pipe which does not have any expansion joint. The ratio (RD/TD) of the diameter (RD) of the dome connecting pipe to the diameter (TD) of the heat accumulation chamber dome approximately meets the condition wherein $0.24 \leqq (RD/TD) \leqq 0.60$, while the ratio (RD/ND) of the diameter (RD) of the dome connecting pipe to the diameter (ND) of the combustion chamber dome approximately meets the condition wherein $0.44 \leqq (RD/ND) \leqq 0.80$. The connecting structure may have a reinforcement ring provided on straight barrel portions immediately under the heat accumulation chamber dome and the combustion chamber dome, and a connecting beam may be fixed at one end to one of the reinforcement rings and engage at its other end with the other of the reinforcement rings for limited sliding motion. The connecting structure may further have a reinforcement member provided in each of the regions where the dome connecting pipe is connected to the heat accumulation chamber dome and the combustion chamber dome.

3 Claims, 10 Drawing Sheets

DOME CONNECTING STRUCTURE OF EXTERNAL COMBUSTION HOT STOVE FOR BLAST FURNACE

BACKGROUND OF THE INVENTION

1. Field of the Invention

The present invention relates to an improvement in a dome connecting structure of an external-combustion hot stove which is annexed to a blast furnace.

More particularly, the present invention is concerned with a structure for mounting a dome connecting member which interconnects separate domes constituting a combustion chamber and a heat accumulation chamber and which does not incorporate any expansion joint.

2. Description of the Related Art

In general, hot stoves for stably supplying hot air at high temperature to a blast furnace have a combustion chamber and a heat accumulation chamber. Hot stoves can broadly be sorted into two types: (a) internal combustion type hot stoves in which the combustion chamber and the heat accumulation chamber are consolidated and (b) external combustion type hot stoves in which these chambers are arranged separately from each other.

The external combustion type is becoming dominant in pace with the current trend for greater scales or sizes of blast furnaces.

Hot stoves of the external combustion type employ a combustion chamber into which blast furnace gas or coke oven gas is introduced to be burnt therein, and also employ a heat accumulation chamber in which the heat generated by the combustion is accumulated.. These chambers are interconnected through a furnace top dome so as to enable accumulation of heat and supply of hot gas the blast furnace.

A conventional connecting structure known as the Koppers type structure employs a straight connecting pipe which interconnects the side walls of a heat accumulation chamber dome and a combustion chamber dome and which incorporates an expansion joint. This type of connecting structure is disclosed, for example, in Japanese Patent Laid-Open Nos. 50-104707 and 53-131906, as well as in Japanese Utility Model Laid-Open No. 55-4285.

FIG. 9 of the drawings shows an example of a hot stove of the Koppers type. This hot stove, denoted by the number 12, has a heat accumulation chamber 1 which is of the self-standing type, and has a combustion chamber 2 situated on a column 3. A dome 9 on the heat accumulation chamber 1 and a dome 10 on the combustion chamber 2 are connected to each other through a dome connecting pipe 4 having an expansion joint 5. When supplying hot gas, an axial force of about 1000 tons acts due to pressure of the gas, tending to move domes 9, 10 away from each other. In order to prevent excessive expansion of the expansion joint 5, therefore, both the heat accumulation chamber dome 9 and the combustion chamber dome 10 are provided with dome ring stiffeners 6 which are interconnected to each other through a tension beam 7. Numeral 8 designates a connection truss which interconnects the heat accumulation chamber 1 and the combustion chamber 2.

As stated above, the hot stove thus constructed produces an axial force of about 1000 tons which acts to tension the tensionbeam 7 during supply of the hot gas. Consequently, the connecting structure, in particular the expansion joint 5, experiences repeated alternating cycles of expansion caused by the pressure of the gas during gas supply and contraction due to gas pressure reduction during combustion. This continues for a very long period, which is usually about 10 to 15 years.

Consequently, refractory bricks lining the expansion joint 5 are caused to crack and to form cavities through which the hot gas reaches the outer shell of the expansion joint 5 making the shell red hot.

Repairing such a damaged expansion joint 5 requires the operator to suspend the operation of the hot stove for a long time so as to cool down the hot stove to enable renewal of the expansion joint 5, during which the number of hot stoves available for operation is reduced, e.g., from 4 to 3, with the result that the efficient operation of the blast furnace is uneconomically affected and much time and huge cost are required.

Simplified and light-weight construction of hot stoves also has been demanded to enable periodic draining of water from the lowest portion of the expansion joint, and to facilitate maintenance.

In order to cope with such a demand while obviating the above-described problems, various connecting structures have been proposed in which thermal expansion is absorbed solely by the rigidity of a connecting pipe, without the aid of the expansion joint. An example of a known hot stove incorporating a dome connecting pipe 4 devoid of expansion joint 5 is shown in FIG. 10. It will be seen that the dome 9 of the heat accumulation chamber 1 and the dome 10 of the combustion chamber 2 are directly connected to each other through a dome connecting pipe 4 which does not have the expansion joint 5 used in the conventional structure shown in FIG. 9. In addition, the dome ring stiffeners 6 and the tension beam 7 used in conventional structures are omitted. Thus, the whole construction is simplified and light-weight due to elimination of the dome ring stiffeners 6 and the tension beam 7, not to mention omission of the expansion joint 5.

In the structure shown in FIG. 10, the elongation of the iron shell of the dome connecting pipe 4 is absorbed by distortions of the heat accumulation chamber 1 and the combustion chamber 2, so that no problem is caused in regard to thermal stress. A problem, however, arises when the hot stove is of the type in which the heat accumulation chamber 1 is of self-standing type while the combustion chamber 2 is situated on the column 3. In such a hot stove stacking of the refractory bricks in the combustion chamber 2 is conducted after the dome 9 of the heat accumulation chamber 1 and the dome 10 of the combustion chamber 2 are connected to each other through the dome connecting pipe 4, so that the column 3 is deflected by the weight of the refractory bricks, with the result that the level of the combustion chamber 2 is lowered with respect to that of the heat accumulation chamber 1.

FIGS. 11A and 11B illustrate the results of an FEM (finite-element method) analysis of stress and deformation at the portion of the heat accumulation chamber dome 9 near the base A of the dome connecting pipe 4 and those at the portion of the combustion chamber dome 10 near the base B of the dome connecting pipe 4. From these results it is understood that the portion of the combustion chamber dome 10 near the base B of the dome connecting pipe 4 suffers from large stress and deformation, whereas the stress and deformation are rather small in the portion of the heat accumulation chamber dome 9 near the base A of the dome connecting pipe 4. Consequently, a substantial reinforcement is required at the knuckle part 11 (FIG. 10) of the portion of the combustion chamber 2 near the base end of the dome connecting pipe 4. In the worst case, it is impossible to build the connecting structure without the expansion joint, thus failing to achieve the intended purpose.

SUMMARY OF THE INVENTION

Accordingly, an object of the present invention is to provide a connecting structure for an external combustion type hot stove which has extended life service and which eliminates the necessity for an expansion joint.

The objects of this invention are achieved by minimizing local stresses at the domes near the base ends of the dome connecting pipe, by designing optimal values of the diameter of the dome connecting pipe to the diameters of the heat accumulation chamber dome and combustion chamber dome in accordance with the results of the FEM analysis.

To this end, according to the present invention, there is provided a connecting structure of a blast furnace hot stove of the type in which a heat accumulation chamber dome and a combustion chamber dome are directly connected to each other through a dome connecting pipe which does not have any expansion joint, wherein the improvement comprises controlling the ratio (RD/TD) of the diameter (RD) of the dome connecting pipe to the diameter (TD) of the heat accumulation chamber dome in accordance with the condition wherein approximately $0.24 \leqq (RD/TD) \leqq 0.60$, while the ratio (RD/ND) of the diameter (RD) of the dome connecting pipe to the diameter (ND) of the combustion chamber dome meets the approximate condition $0.44 \leqq (RD/ND) \leqq 0.80$.

In one form of the invention the connecting structure comprises a reinforcement ring provided on each straight barrel portion immediately under the heat accumulation chamber dome and immediately under the combustion chamber dome, and a connecting beam which is fixed at one end to one of the reinforcement rings and engaging at its other end with the other of the reinforcement rings for sliding motion by a predetermined amount relative thereto.

These and other objects, features and advantages of the present invention will become clear from the following description of the preferred embodiments when the same is read in conjunction with the accompanying drawings.

DETAILED DESCRIPTION OF THE INVENTION

Figure 1:
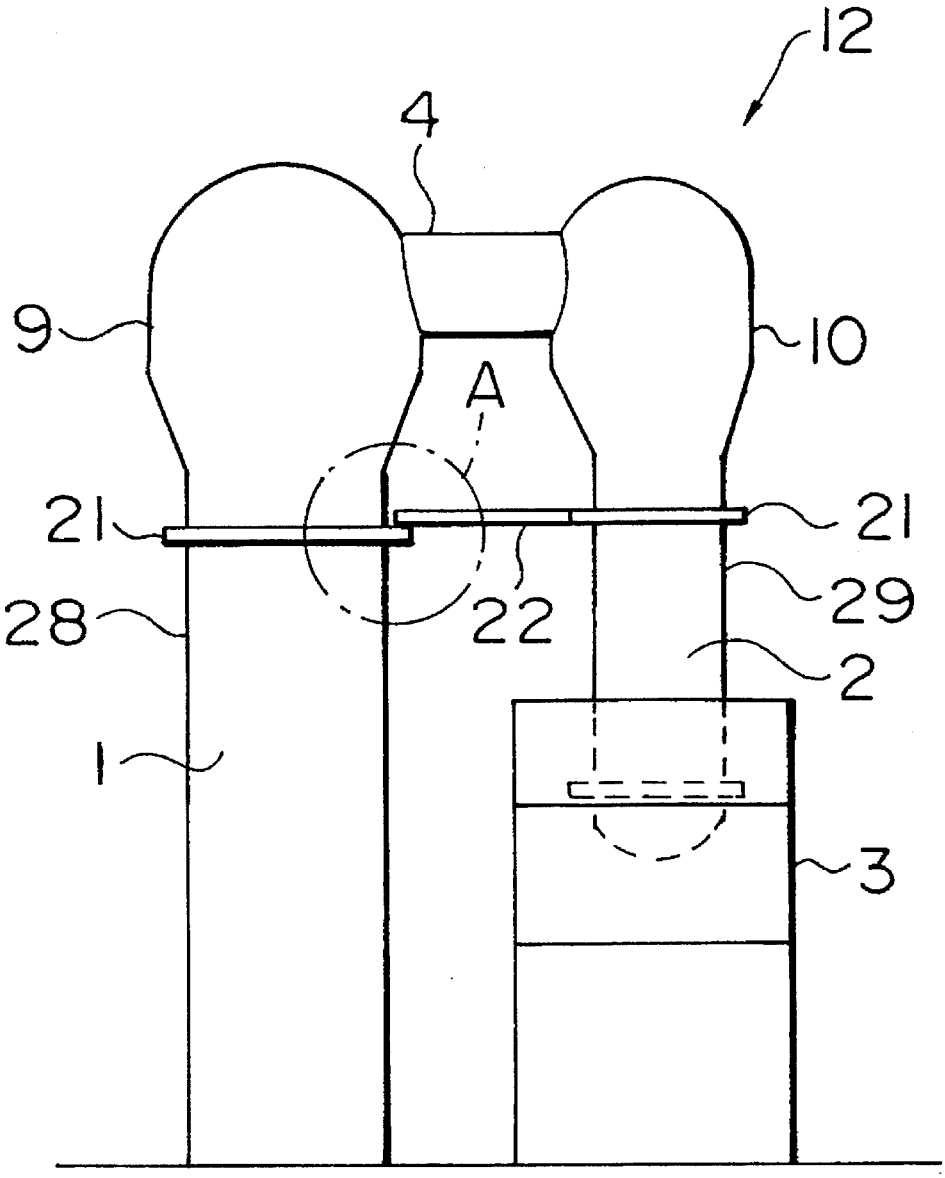
FIG. 1 is a front elevational view of one embodiment of the connecting structure in accordance with the present invention.

Using a plurality of strain gauges we have measured stresses occurring in the conventional connecting structure having a dome connecting pipe 4 with an expansion joint 5 and have compared them with the connecting structure of the invention which incorporates a straight connecting pipe without any expansion joint 5, at the time of start-up of the hot stoves. According to the results of the measurement on the conventional connecting structure employing the expansion joint 5, repeated relative displacement of magnitude of 2.3 cm was observed between the tops of the domes 9 and 10 as a result of the repeated switching between gas supplying operation and the combustion operation. This has had a serious and damaging effect on the lining refractory bricks.

In contrast, in the connecting structure of the invention in which the ratios of the diameter RD of the dome connecting pipe 4 to the diameters TD and ND of the heat accumulation chamber dome 9 and combustion chamber dome 10 fall approximately within the ranges of this invention, the amount of the relative movement was as small as 0.3 cm so that the stress was small enough to eliminate necessity for any reinforcement and to avoid any undesirable effect on the lining refractory bricks.

When the ratio RD/TD is less than about 0.44 or when the ratio RD/ND is less than about 0.24, the diameter RD of the dome connecting pipe 4 is so small that an offset of flow of the gas in the stove takes place during combustion and during supply of the gas, thus hampering safe operation of the hot stove. On the other hand, when the ratio RD/TD exceeds about 0.60 or when the ratio RD/ND exceeds about 0.80, the local stress in the knuckle increases excessively so that it necessitates reinforcement. It is therefore necessary that the ratios RD/TD and RD/ND fall within the approximate ranges described before.

According to the invention the straight barrel portion 28 (FIG. 1) immediately under the heat accumulation chamber dome 9 and the straight barrel portion 29 immediately under the combustion chamber dome 10 are reinforced with spaced-apart reinforcement rings 21, 21 which are connected to each other through a connecting beam 22 which slidably engages with these reinforcement rings 21. Therefore, when the dome connecting pipe 4 is axially expanded due to internal gas pressure during supply of the hot gas, the expansion is stopped at a certain point by the connecting beam 22. Consequently, any detrimental influence on the refractory bricks lining the dome connecting pipe 4 is avoided.

The reinforcement rings 21 and the connecting beam 22 also function as a safety structure which prevents breakdown when the dome connecting pipe 4 is damaged. It allows easy axial extension thereof due to internal pressure. Thus, the axial force acting on the dome connecting pipe 4 during supply of the hot gas is borne by the dome connecting pipe 4 itself, whereas, in the event of a failure of the dome connecting pipe 4, the connecting beam 22 serves to limit axial expansion of the dome connecting pipe 4. Thus, the reinforcement rings 21, 21 and the connecting beam 22 are provided with strengths large enough to sustain the internal pressure during supply of the hot gas.

The amount of slide of the connecting beam 22 has to be large enough to accommodate thermal expansion of the iron shell of the dome connecting pipe 4 which is caused due to temperature rise during the operation of the hot stove.

In a preferred form of the present invention, a reinforcement member 23 is provided (FIG. 8) in the regions where the dome connecting pipe 4 is connected to the heat accumulation chamber dome 9 and the combustion chamber dome 10, thus preventing stress corrosion cracking which otherwise may be caused at such regions.

Figure 12:
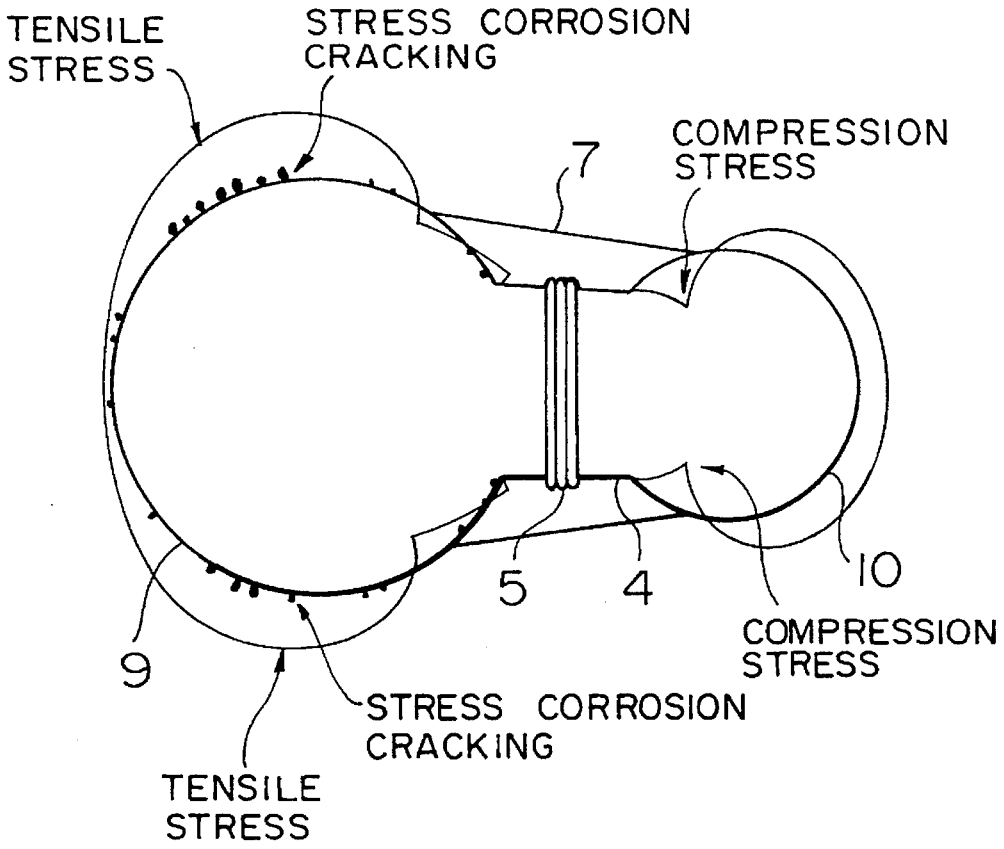
FIG. 12 is an illustration of stress distribution and positions where stress corrosion cracking is taking place in the conventional structure shown in FIG. 9.

When there is an expandable portion, axial thrusting force on the expandable portion is borne by the tension beam 7 (FIG. 12). This force is transmitted to the dome ring stiffeners 6 so that a stress distribution is developed on the inner surface of the iron shell of the dome as shown in FIG. 12. As will be seen from this Figure, compression stress acts on the regions where the dome connecting pipe 4 is connected to the heat accumulation chamber dome 9 and the combustion chamber dome 10, while other portions sustain tensile stress. The stress corrosion cracking mentioned above appears most heavily in the local regions where the tensile stress is maximized.

The reinforcement members 23 (FIG. 8) provided in the regions where the dome connecting pipe 4 is connected to both domes 9, 10 effectively disperse the stresses, thus contributing to suppression of stress corrosion cracking.

A preferred embodiment of the present invention will now be described with reference to FIG. 1 which is a front elevational view of the entire hot stove incorporating the dome connecting structure of the present invention, and also to FIG. 2 which is an illustration of details of the present invention.

Figure 2:
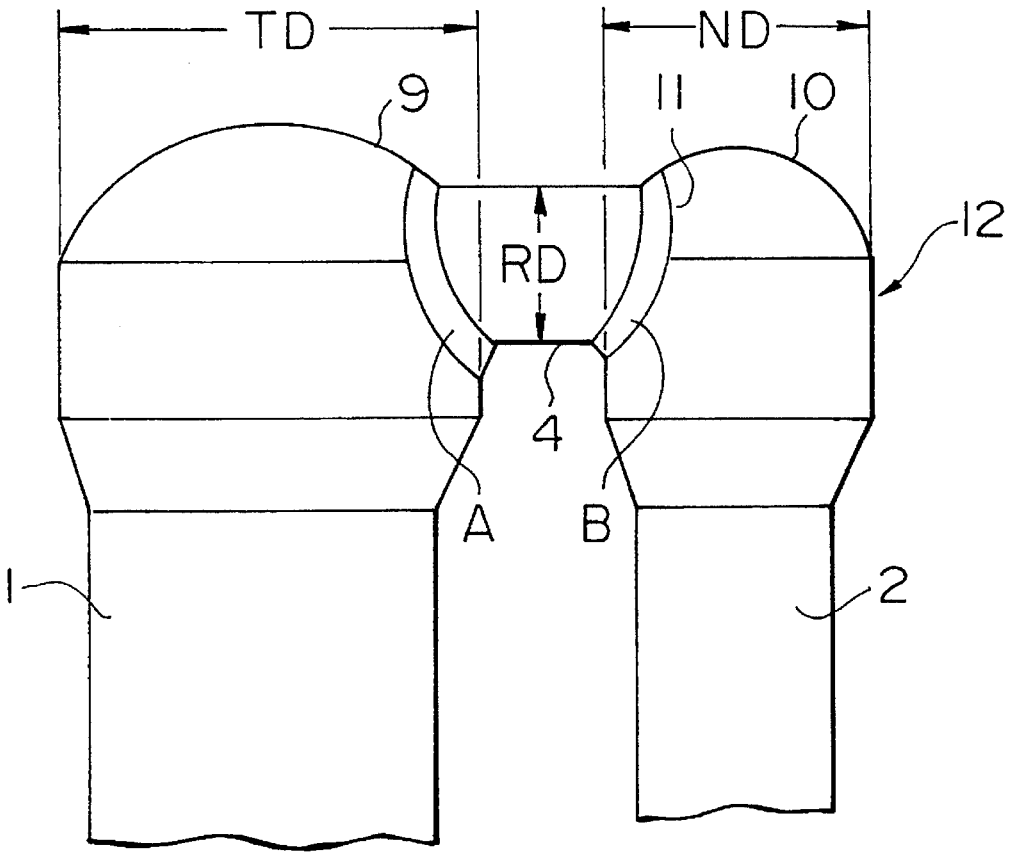
FIG. 2 is a detailed illustration of an apparatus according to the present invention.

Referring to FIG. 2, an external combustion hot stove 12 has a dome 9 defining a heat accumulation chamber 1 and a dome 10 defining a combustion chamber 2. These domes are directly connected to each other at their side walls through a dome connecting pipe 4. According to the present invention, the ratio (RD/TD) of the diameter (RD) of said dome connecting pipe to the diameter (TD) of said heat accumulation chamber dome meets the approximate condition of $0.24 \leqq (RD/TD) \leqq 0.60$, while the ratio (RD/ND) of the diameter (RD) of said dome connecting pipe to the diameter (ND) of the combustion chamber dome meets the approximate condition of $0.44 \leqq (RD/ND) \leqq 0.80$. By applying these conditions it is possible to suppress stresses occurring in the regions A and B near the base ends of the dome connecting pipe 4, particularly the stress occurring in the region B adjacent to the combustion chamber dome 10.

Figure 3:
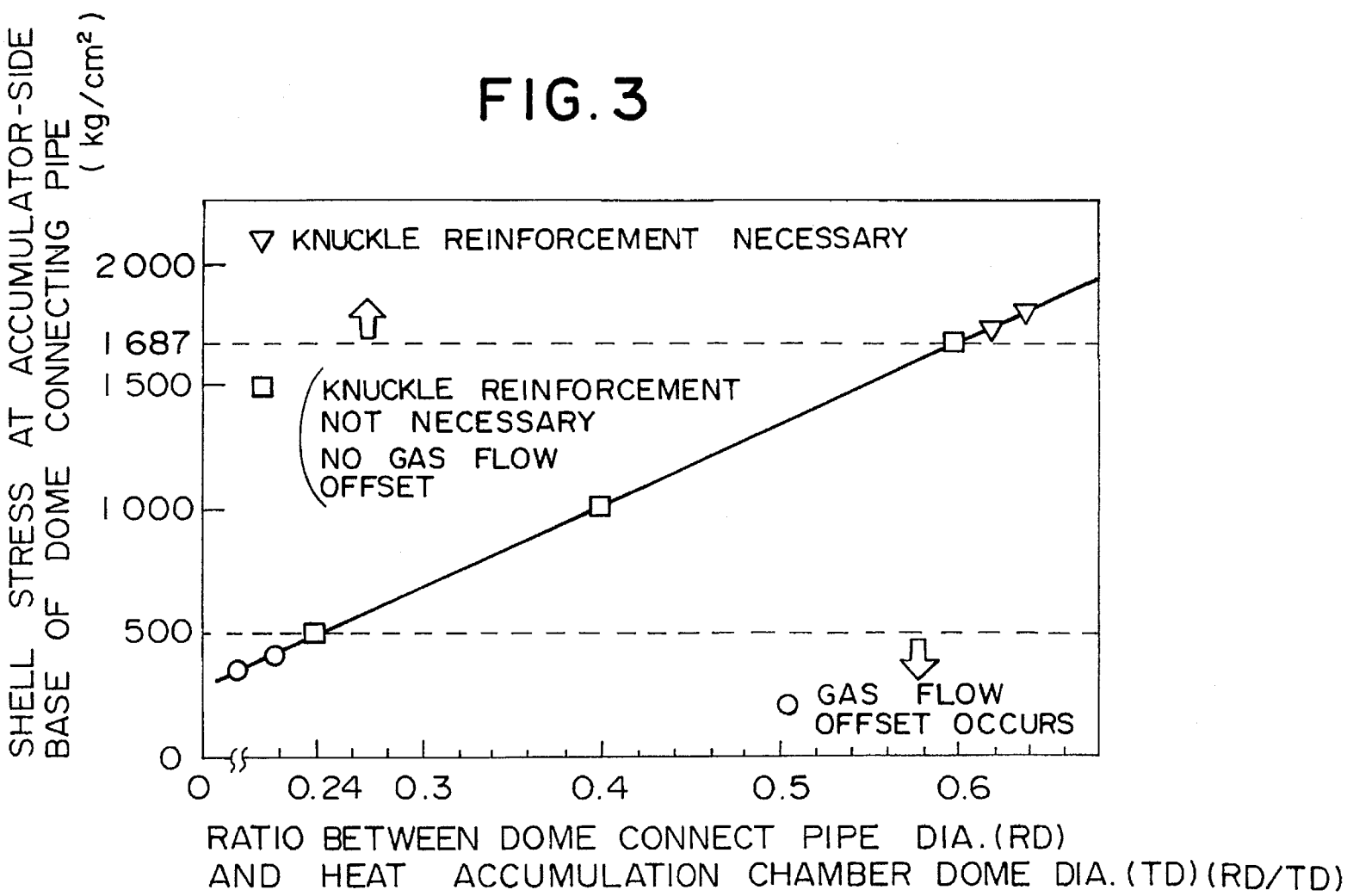
FIG. 3 is a graph showing stresses generated in the heat accumulation chamber iron shell at the knuckle where a dome connecting pipe is connected in relation to the ratio (RD/TD) of the dome connecting pipe diameter RD to the heat accumulation chamber dome diameter TD, illustrative of critical conditions for provision of reinforcement of the knuckle part and for existence of offset of the gas flow.

FIG. 3 is a graph showing the stress generated in the heat accumulation chamber iron shell at the knuckle 11 where a dome connecting pipe is connected in relation to the ratio (RD/TD) of the dome connecting pipe diameter RD to the heat accumulation chamber dome diameter TD, illustrative of the critical conditions for provision of reinforcement of the knuckle part 11 and for existence of offset of the gas flow. From this Figure, it will be seen that any defect such as cracking of the iron shell can be avoided without requiring reinforcement of the iron shell at the knuckle part 11, while preventing offset of flow of hot gas during combustion, as well as during supplying of the hot gas, when the ratio (RD/TD) ranges from about 0.24 to 0.60. As will be also seen from FIG. 3, the stress in the iron shell is 500 $kg/cm^2$ when the ratio (RD/TD) is 0.24 and 1,687 $kg/cm^2$ when the same is 0.60.

When the ratio (RD/TD) is below about 0.24, operation of the hot stove is hampered due to generation of offset of the gas flow, although the stress in the iron shell can be appreciably reduced. Conversely, when the ratio (RD/TD) exceeds about 0.60, the stress in the iron shell at the knuckle part near the base end of the dome connecting pipe is increased to a level which requires reinforcement. For these reasons the ratio (RD/TD) should fall approximately within the range of $0.24 \leqq (RD/TD) \leqq 0.60$.

Figure 4:
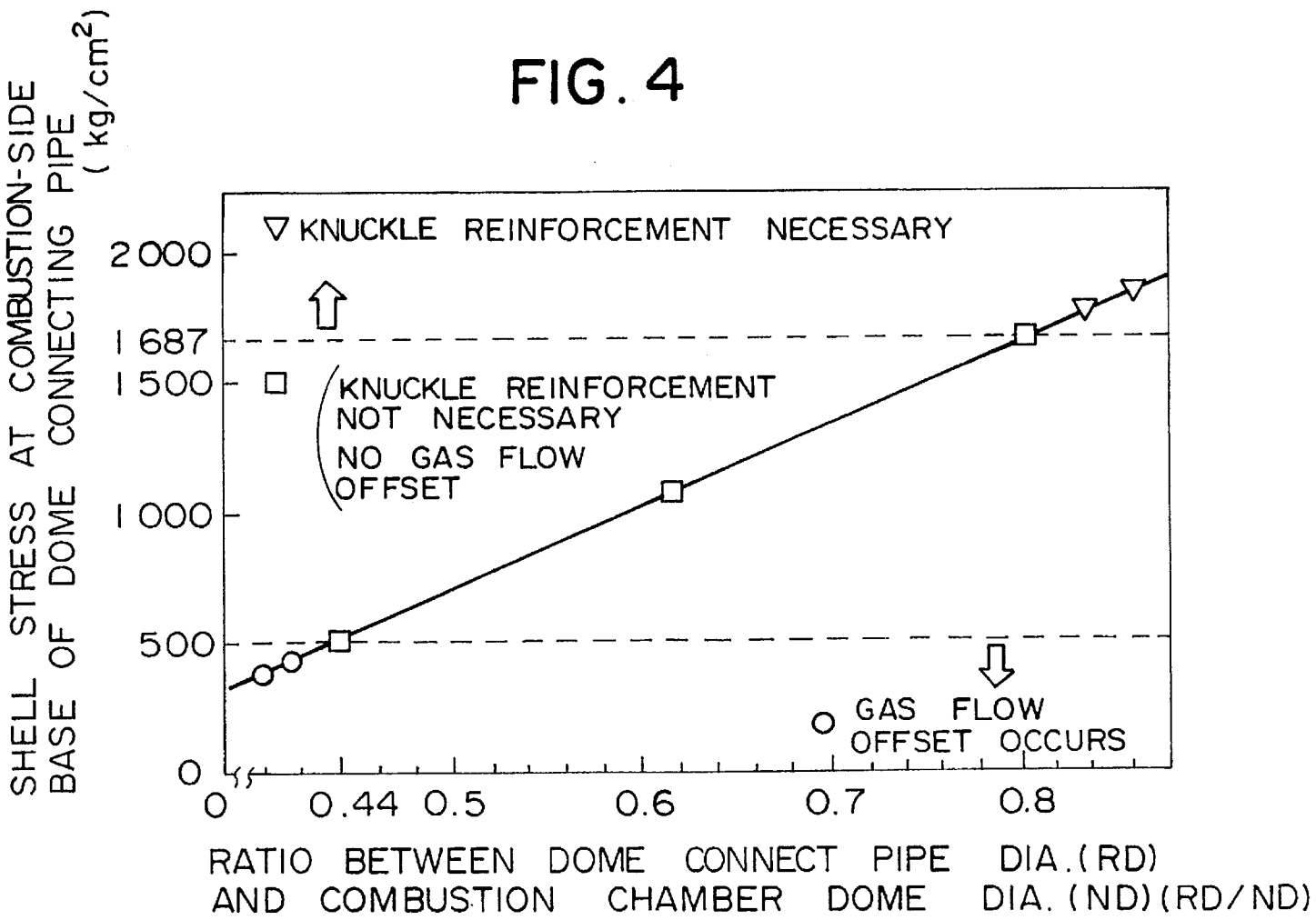
FIG. 4 is a graph showing stresses generated in the combustion chamber iron shell at the knuckle where a dome connecting pipe is connected in relation to the ratio (RD/ND) of the dome connecting pipe diameter RD to the combustion chamber dome diameter ND, illustrative of critical conditions for reinforcement of the knuckle part and for existence of offset of gas flow.
Figure 5:
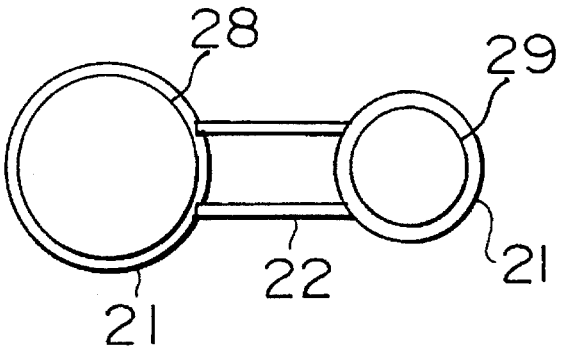
FIG. 5 is a plan view showing a construction for connecting together a reinforcement ring and a connecting beam.

FIG. 4 is a graph showing the stress generated in the heat accumulation chamber iron shell at the knuckle 11 where a dome connecting pipe is connected in relation to the ratio (RD/ND) of the dome connecting pipe diameter RD to the combustion chamber dome diameter ND, illustrative of the critical conditions for provision of reinforcement of the knuckle part 11 and for existence of offset of the gas flow. From this Figure, it will be seen that any problem such as cracking of the iron shell can be avoided without requiring reinforcement of the iron shell at the knuckle part 11, while preventing offset of flow of hot gas during combustion, as well as during supplying of the hot gas, when the ratio (RD/ND) ranges from about 0.44 to about 0.80. As will be also seen from FIG. 4, the stress in the iron shell is 500 $kg/cm^2$ when the ratio (RD/ND) is 0.44 and 1,687 $kg/cm^2$ when the same is 0.80.

When the ratio (RD/ND) is below about 0.44, operation of the hot stove is hampered due to generation of offset of the gas flow although the stress in the iron shell can be appreciably reduced. Conversely, when the ratio (RD/ND) exceeds about 0.80, the stress in the iron shell at the knuckle part 11 near the base end of the dome connecting pipe is increased to a level which requires reinforcement. For these reasons, the ratio (RD/TD) should fall within the range of $0.44 \leqq (RD/ND) \leqq 0.80$.

Obviously, the dome connecting pipe diameter Rd is preferably determined to simultaneously meet the approximate conditions of $0.24 \leqq (RD/TD) \leqq 0.60$ and $0.44 \leqq (RD/ND) \leqq 0.80$.

The present invention can be applied also to a hot stove of the type which employs a combustion chamber 2 which is self-standing without being carried by a column.

A different embodiment of the present invention will be described with reference to FIGS. 1, 5, 6, 7 and 8.

In this embodiment, a heat accumulation chamber dome 9 and a combustion chamber dome 10 are connected to each other through a straight dome connecting pipe 4, and reinforcement rings 21, 21 are provided to embrace straight barrel portions 28 and 29 under the heat accumulation chamber dome 9 and combustion chamber dome 10. These reinforcement rings are connected to each other through a connecting beam 22.

More specifically, the connecting beam 20 is connected at one end to the reinforcement ring 21 on the straight barrel 29 immediately under the combustion chamber dome 10, while the other end of the same slidably engages with the reinforcement ring 21 on the straight barrel 28 immediately under the heat accumulation chamber dome 9 for sliding motion relative thereto in a suitable amount.

Figure 6:
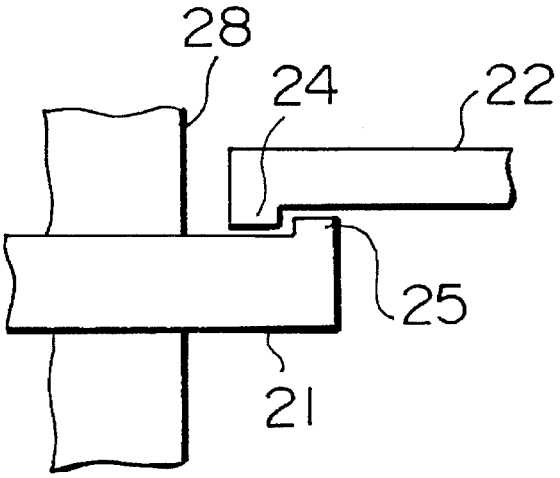
FIG. 6 is an enlarged front elevational view of a portion marked as A in FIG. 1.

As will be clearly seen from FIG. 6, a projection 24 is provided on the end of the connecting beam 22, while the reinforcement ring 21 on the straight barrel 28 immediately under the heat accumulation chamber dome 9 is provided with a stopper 25 engageable with the projection 24. In the event of a rupture or breakdown of the dome connecting pipe 4, the dome connecting pipe 4 tends to be elongated excessively. In such a case, this elongation is limited by engagement between the projection 24 and the stopper 25, thus preventing breakdown of the lining bricks inside the dome connecting pipe. Usually a certain amount of play is left between the projection 24 and the stopper 25 so as to accommodate elongation of the dome connecting pipe 4 due to thermal expansion and internal gas pressure.

Figure 7:
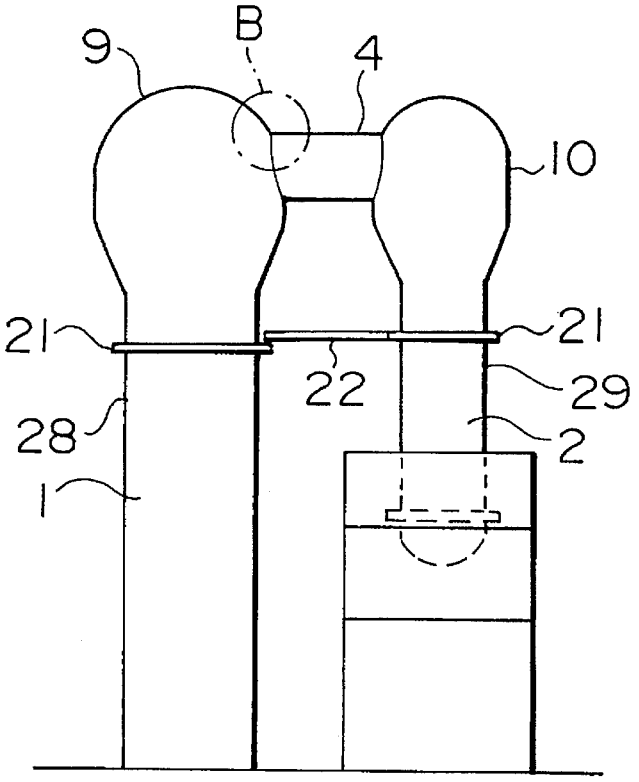
FIG. 7 is a front elevational view of another embodiment of the present invention.
Figure 8:
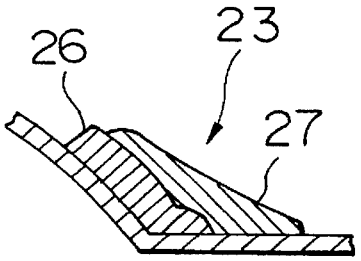
FIG. 8 is an enlarged sectional view of a portion marked by B in FIG. 7.
Figure 9:
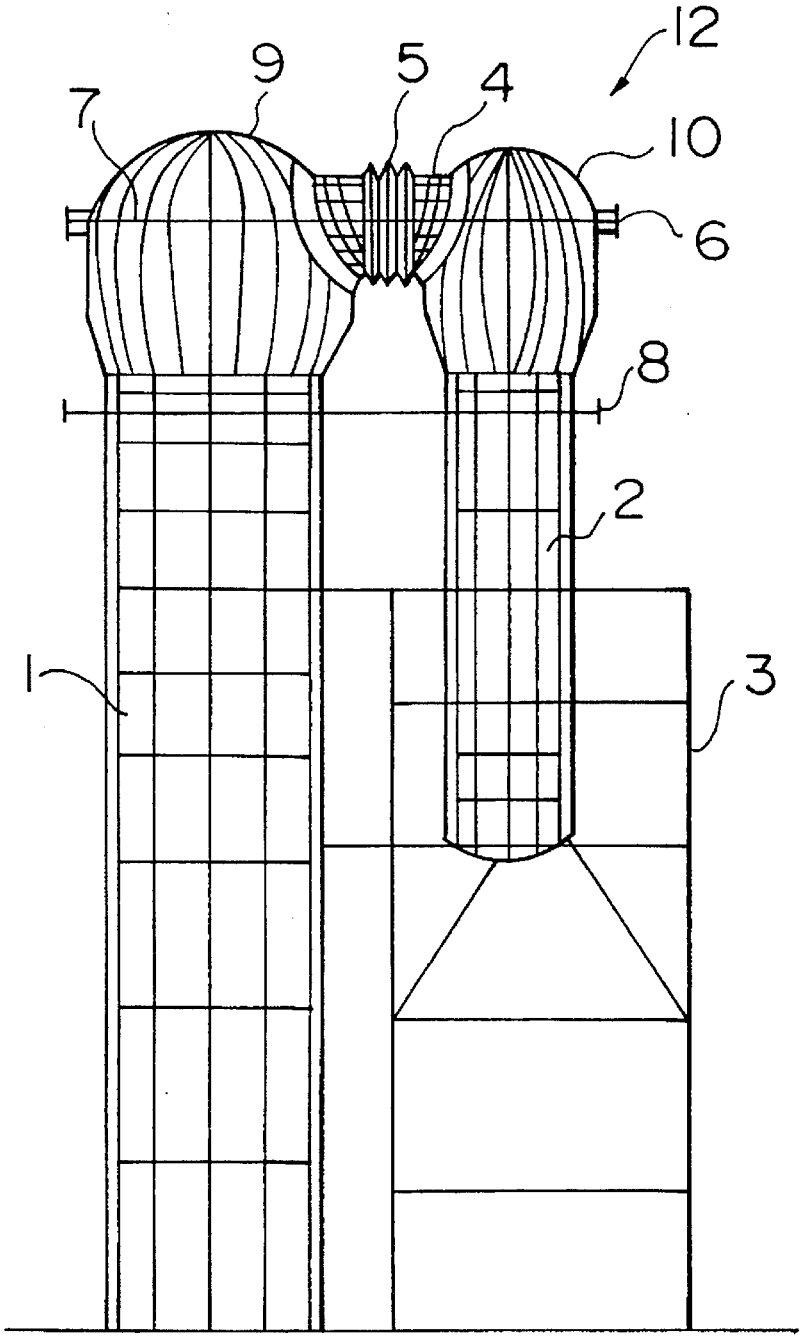
FIG. 9 PRIOR ART
FIG. 9 is a side elevational view of an external combustion hot stove using a conventional connecting structure having a connecting pipe employing an expansion joint.
Figure 10:
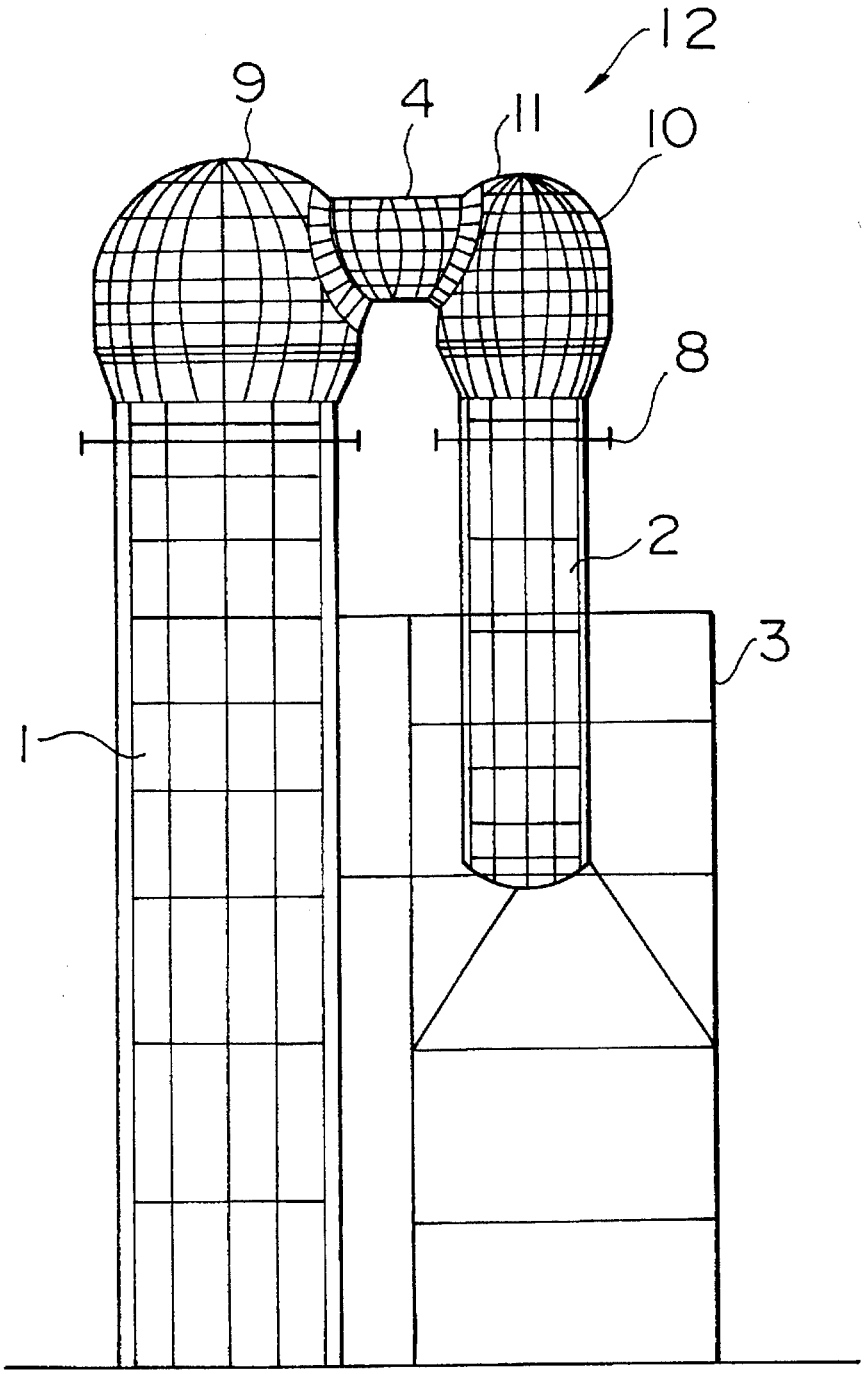
FIG. 10 PRIOR ART
FIG. 10 is a side elevational view of an external combustion hot stove using a conventional connecting structure having a connecting pipe devoid of expansion joint.
Figure 11A:
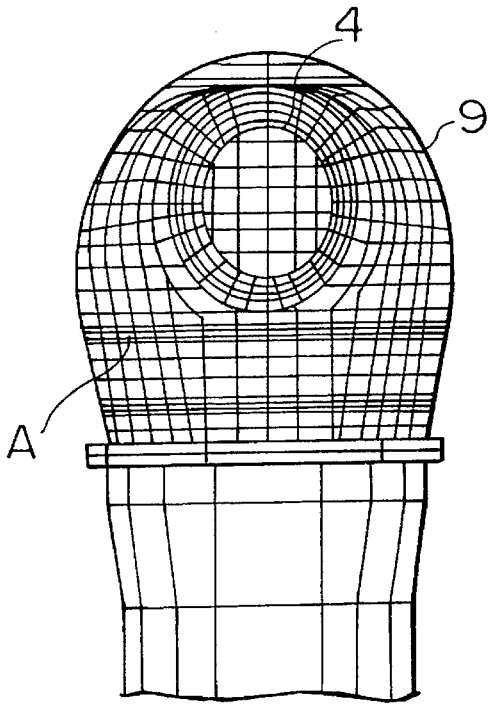
FIG. 11A is an illustration of the deformation of the iron shell of the portion of the heat accumulation chamber in the vicinity of the base end of a connecting pipe in the conventional connecting structure.
Figure 11B:
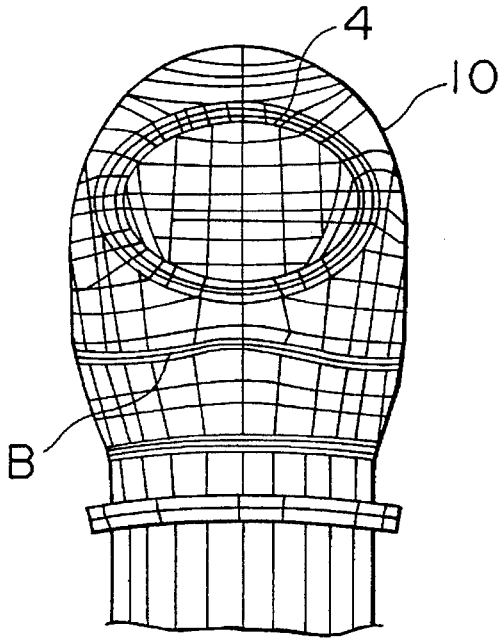
FIG. 11B is an illustration of the deformation of the iron shell of the portion of the combustion chamber in the vicinity of the base end of a connecting pipe in the conventional connecting structure.

FIGS. 7 and 8 show a different embodiment. This embodiment employs reinforcement members 23 provided in the regions where the dome connecting pipe 4 is connected to the heat accumulation chamber dome 9 and the combustion chamber dome 10. As will be seen from FIG. 8, each reinforcement member 23 is composed of a doubling plate 26 welded to the external surface of each dome and a rib plate 27 which is welded both to the doubling plate 26 and to the external surface of the dome connecting pipe 4 so as to smoothly connect them.

The reinforcement members 23 effectively disperse the stresses occurring in the regions of the heat accumulation chamber dome 9 and combustion chamber dome 10 where the dome connecting pipe 4 is connected, thus preventing generation of stress corrosion cracking which otherwise maybe caused by local stress concentration.

Although in the embodiment shown in FIG. 8 the reinforcement member 23 is composed of a doubling plate and the ring plate 27 welded thereto, this arrangement is not the only useful one and any other construction capable of dispersing stress can be used equally well.

As will be understood from the foregoing description, the present invention can effectively be applied to an external combustion hot stove of the type in which the walls of a heat accumulation chamber dome and a combustion chamber dome are directly connected to each other through a connecting pipe which is devoid of any expansion joint, so as to reduce stresses occurring in the iron shell in the regions near the base ends of the dome connecting pipe, while suppressing offset of the furnace gas during the combustion phase and the gets supply phase during operation of the hot stove. Consequently, the external combustion hot stove can operate in a stable manner for a long time without problems due to generation of excessive stresses at these regions.

According to the present invention the dome connecting pipe is devoid of any expansion joint and is formed of a straight pipe which exhibits a small displacement of the iron shell. It is therefore possible to eliminate damage to the refractory bricks, which damage otherwise may be caused by large displacement of the dome connecting pipe, thus ensuring extended life of the hot stove.

In one form of the invention the heat accumulation chamber dome and the combustion chamber dome are connected to each other through a connecting beam one end of which is slidable relative to the associated dome. The extension beam limits excessive elongation of the dome connecting pipe in the event of breakdown of the dome connecting pipe, thus contributing to the extension of the life of the hot stove.

Furthermore, it is possible to distribute or disperse the stress on the reinforcement ring, by virtue of the reinforcement member provided at the region where the dome connecting pipe is connected to each dome, thereby preventing occurrence of stress corrosion cracking which hitherto has occurred in the reinforcement ring.

Although this invention has been described with reference to several specific embodiments,, it will be appreciated that many other variations and equivalents may be substituted for the specific elements selected for illustration in the drawings. Equivalent elements may be substituted and certain features of the invention may be used independently of other features, all within the spirit and scope of the invention as set forth in the appended claims.

What is claimed is:

1. A connecting structure of a blast furnace hot stove of the type having a heat accumulation chamber dome and a combustion chamber dome spaced apart from each other, wherein said domes are directly connected to each other through a dome connecting pipe which does not have any expansion joint, and wherein the ratio (RD/TD) of the diameter (RD) of said dome connecting pipe to the diameter (TD) of said heat accumulation chamber dome meets the condition of about $0.24 \leqq (RD/TD) \leqq 0.60$, while the ratio (RD/ND) of the diameter (RD) of said dome connecting pipe to the diameter (ND) of the combustion chamber dome meets the condition of about $0.44 \leqq (RD/ND) \leqq 0.80$.

2. A connecting structure of a blast furnace hot stove of the type having a heat accumulation chamber dome and a combustion chamber dome spaced apart from each other, comprising:

a straight barrel support positioned immediately under said heat accumulation chamber dome and a straight barrel support positioned immediately under said combustion chamber dome, a reinforcement ring positioned on each of said supports, and a connecting beam which is fixed at one end of each of said reinforcement rings and engaging at the other end of the other of said reinforcement rings for limited sliding motion relative thereto, wherein said domes are directly connected to each other through a dome connecting pipe which does not have any expansion joint, wherein the ratio (RD/TD) of the diameter (RD) of said dome connecting pipe to the diameter (TD) of said heat accumulation chamber dome meets the condition of about $0.24 \leqq (RD/TD) \leqq 0.60$, while the ratio (RD/ND) of the diameter (RD) of said dome connecting pipe to the diameter (ND) of the combustion chamber dome meets the condition of about $0.44 \leqq (RD/ND) \leqq 0.80$.

3. A connecting structure according to claim 2, further comprising a reinforcement member provided in each of the regions where said dome connecting pipe is connected to said heat accumulation chamber dome and :said combustion chamber dome.

* * * * *